US012618632B2

(12) United States Patent
Sanders et al.

(10) Patent No.: US 12,618,632 B2
(45) Date of Patent: May 5, 2026

(54) OFF-AXIS SERPENTINE FLOW CHAMBER FOR FIREARM SUPPRESSORS

(71) Applicant: HuxWrx Safety Co. LLC, Millcreek, UT (US)

(72) Inventors: David Sanders, Millcreek, UT (US); A. Kai Bradshaw, Millcreek, UT (US); Russell Tobler, Millcreek, UT (US)

(73) Assignee: HuxWrx Safety Co. LLC, Millcreek, UT (US)

( * ) Notice: Subject to any disclaimer, the term of this patent is extended or adjusted under 35 U.S.C. 154(b) by 0 days.

(21) Appl. No.: 19/057,366

(22) Filed: Feb. 19, 2025

(65) Prior Publication Data

US 2025/0264290 A1 Aug. 21, 2025

Related U.S. Application Data

(60) Provisional application No. 63/555,837, filed on Feb. 20, 2024.

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/34; F41A 21/36; F41A 21/38; F41A 21/40
See application file for complete search history.

(56) References Cited

U.S. PATENT DOCUMENTS 2,359,365 A * 10/1944 Katcher ..... F01N 1/12 181/280
2,792,760 A 5/1957 Hammer
2,911,055 A * 11/1959 Mcdonald ..... F01N 1/12 181/280
3,667,570 A 6/1972 WerBell, III
(Continued)

FOREIGN PATENT DOCUMENTS

CN 110425929 11/2019
IN 202121003854 2/2021

OTHER PUBLICATIONS

John Patton, Are spiral baffles the future? Stealth Project Bolt Suppressor Review!, YouTube, Sep. 29, 2022, 4 pages.
(Continued)

*Primary Examiner* — Joshua E Freeman
(74) *Attorney, Agent, or Firm* — Thorpe North & Western, LLP

(57) ABSTRACT

A firearm sound suppressor can include an outer housing that defines a bore axis and an inner wall disposed at least partially within the outer housing. The inner wall can be oriented along the bore axis and includes a cylindrical central chamber. An annular chamber can be disposed between the outer housing and the inner wall. At least one helical partition can be disposed in the annular chamber to define at least one interleaved helical pathway through the annular chamber. Each interleaved helical pathway includes a first forward helical segment, a reverse helical segment sharing a first common wall with the first forward helical segment, and a second forward helical segment sharing a second common wall with the reverse helical segment. The first and second common walls can be distinct from one another.

23 Claims, 11 Drawing Sheets

(56) References Cited

U.S. PATENT DOCUMENTS

| | | | | |
|---|---|---|---|---|
| 3,888,331 | A * | 6/1975 | Wang | F01N 1/06 181/280 |
| 5,029,512 | A * | 7/1991 | Latka | F41A 21/30 89/14.4 |
| 5,361,677 | A | 11/1994 | Warner et al. | |
| 8,286,750 | B1 | 10/2012 | Oliver | |
| 9,874,418 | B2 | 1/2018 | White et al. | |
| 10,393,463 | B1 * | 8/2019 | Sanders | F41A 21/34 |
| 10,488,137 | B1 * | 11/2019 | Dean | F41A 21/30 |
| 10,634,445 | B1 | 4/2020 | Klett | |
| 10,753,699 | B2 | 8/2020 | Klett et al. | |
| 11,680,764 | B1 | 6/2023 | Bray | |
| 12,264,889 | B2 * | 4/2025 | Ricci | F41A 21/30 |
| 12,276,467 | B2 * | 4/2025 | Spector | F41A 21/30 |
| 2014/0216237 | A1 | 8/2014 | Butler | |
| 2014/0224574 | A1 * | 8/2014 | Latka | F41A 21/30 181/223 |
| 2017/0067711 | A1 * | 3/2017 | Slack | F41A 21/30 |
| 2017/0321985 | A1 * | 11/2017 | Bray | F41A 21/34 |
| 2019/0257607 | A1 | 8/2019 | Dobrinescu | |
| 2020/0109907 | A1 * | 4/2020 | Klett | F41A 21/30 |
| 2021/0180902 | A1 * | 6/2021 | Bray | F41A 21/30 |
| 2023/0341207 | A1 * | 10/2023 | Bray | F41A 21/32 |
| 2024/0142189 | A1 * | 5/2024 | Jarvis | F41A 21/30 |
| 2024/0240896 | A1 * | 7/2024 | Ricci | F41A 21/30 |

OTHER PUBLICATIONS

HUXWRX Safety Co., OSS Suppressors: Helix-QD—Flow-Through, YouTube, 2 pages, https://osssuppressors.com/.

* cited by examiner

OFF-AXIS SERPENTINE FLOW CHAMBER FOR FIREARM SUPPRESSORS

CROSS REFERENCE TO RELATED APPLICATIONS

This application claims priority to U.S. Provisional Patent Application No. 63/555,837, filed Feb. 20, 2024 which is incorporated herein by reference.

BACKGROUND

Discharging a firearm causes gases to be produced through rapid, confined burning of a propellant that accelerates a projectile. This typically creates a loud noise and a flash of light at the muzzle. Often, it is desirable to reduce the amount of noise and light produced by discharging a firearm. Suppressors, or silencers, are typically connected to the muzzle end of a firearm to temporarily capture gas that exits the muzzle. Some suppressor designs divert a portion of the discharge gas to a secondary chamber, such that the gas does not exit the suppressor by the same path as the projectile. The gas is released from the suppressor at a significantly reduced pressure. In general, the more gas a suppressor captures, the quieter the discharge sound of the firearm.

Providing a suppressor that can capture more gas can be challenging because typically, suppressors increase back-pressure in the barrel, which can result in increased wear on firearm component as well as increasing felt recoil. Another challenge is that as a suppressor becomes larger, an operator's performance with the firearm can be adversely affected because of factors related to, for example, length, weight, or diameter (e.g., reducing the operator's maneuverability or quickness, blocking the operator's vision).

SUMMARY

This invention relates to an off-axis serpentine flow chamber that can be used with firearms sound suppressors. The flow chamber may include an inner wall disposed at least partially within an outer housing that defines a bore axis. The inner wall can be oriented about and along the bore axis and includes a cylindrical central chamber (also coaxial with the bore axis). The flow chamber can also include an annular chamber disposed between the outer housing and the inner wall. At least one helical partition can be disposed in the annular chamber to define at least one interleaved helical pathway through the annular chamber. The interleaved helical pathway includes a first forward helical segment, a reverse helical segment sharing a first common wall with the first forward helical segment, and a second forward helical segment sharing a second common wall with the reverse helical segment. The first common wall and the second common wall can be distinct from one another.

The nested serpentine flow pathway can allow discharge gases to travel helically back and forth (e.g., forward and rearward). This approach can result in very little or no change in back pressure and substantially similar exit velocity compared to unsuppressed operation of the same firearm, which can reduce wear on firearms components. The back and forth travel can also reduce the length of the suppressor compared to other designs with similar sound suppression performance, which can allow the operator to use suppression with fewer adverse effects on the operator's performance with the firearm.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1B:
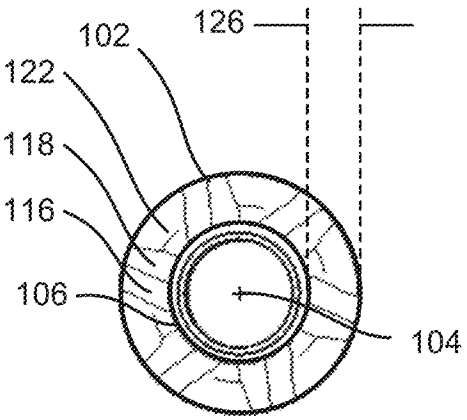
FIG. 1B is a cross-section view across A-A of FIG. 1B.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "a wall" includes reference to one or more of such features and reference to "engaging" refers to one or more of such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility and imprecision associated with a given term, metric or value. The degree of flexibility for a particular variable can be readily determined by one skilled in the art. However, unless otherwise enunciated, the term "about" generally connotes flexibility of less than 2%, and most often less than 1%, and in some cases less than 0.01%.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As used herein, the term "at least one of" is intended to be synonymous with "one or more of." For example, "at least one of A, B and C" explicitly includes only A, only B, only C, or combinations of each.

Numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

As used herein, the term "suppressor" refers to a device installed on the end of a barrel of a firearm that reduces the acoustic intensity of a muzzle report or gunshot.

As used herein, the term "choke tube" refers to a cylindrical tube that screws into the end of a shotgun barrel. Different choke tubes may vary an exit constriction to affect the size and distribution of a pellet pattern at various distances.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

EXAMPLE EMBODIMENTS

A technology is described for an off-axis serpentine flow chamber that can be used with firearm sound suppressors. The off-axis serpentine flow chamber can be used to suppress muzzle reports of a variety of firearms. For example, the flow chamber can be used to suppress muzzle reports of shotguns, handguns, and rifles. In some configurations, the flow chamber can also be used to suppress muzzle reports of other larger projectile weapons, such as mortar launchers.

Figure 1A:
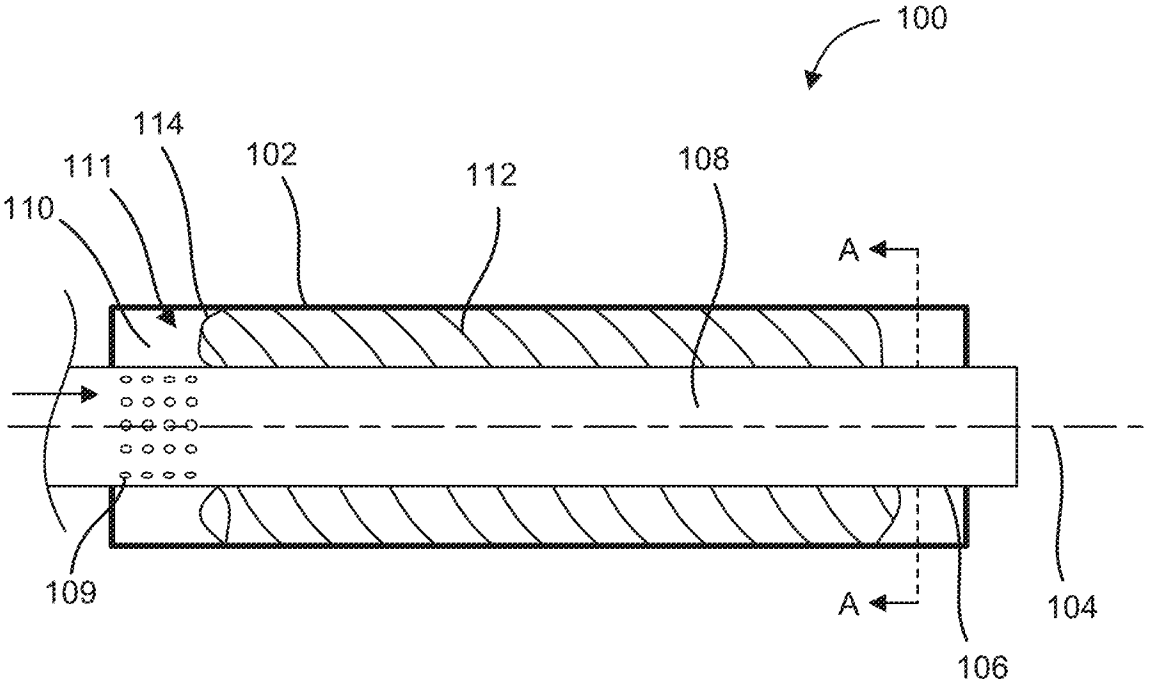
FIG. 1A illustrates an example firearm suppressor that can be used to implement an off-axis serpentine flow chamber, including an interleaved helical pathway and a cylindrical central chamber in accordance with one example.

FIG. 1A illustrates an example firearm suppressor 100 that can be used to implement an off-axis serpentine flow chamber. As illustrated, the example firearm suppressor 100 includes an outer housing 102 defining a bore axis 104, an inner wall 106 disposed at least partially within the outer housing 102. Although not specifically limited, as a general guideline the outer housing can have a length corresponding to a particular platform (i.e. rifle, shotgun, pistol, or large caliber such as mortars or other artillery). However, in one example, the outer housing 102 can have a length from about 10 centimeters to about 50 centimeters, and in some cases about 15 cm to about 30 cm. Similarly, a diameter of the housing 102 can range from about 20 millimeters to about 55 millimeters, depending on the corresponding caliber. Although the outer housing 102 can have varied shaped, most often the outer housing can be cylindrical about the bore axis 104. In other cases, the outer housing 102 can have another shape or can be oriented off-axis. For example, the outer housing can be oriented non-concentric about the bore axis 104. Further, although typically circular as shown in FIG. 1B, the outer housing 102 can have an oblong, rectangular, square, hexagonal, octagonal, etc. cross-sectional shape. When a non-circular outer housing is used, in some examples, an intermediate wall can be introduced to provide a cylindrical wall or barrier as an outer circumferential wall to interleaved helical pathways as described in more detail below.

The inner wall 106 can be oriented about and centered along the bore axis 104 and defines a cylindrical central chamber 108. The example firearm suppressor 100 can also include an annular chamber 110 disposed between the outer housing 102 and the inner wall 106, and at least one helical partition 112 disposed in the annular chamber 110 to define at least one interleaved helical pathway 114 through the annular chamber 110.

The inner wall 106 can be substantially continuous and free of apertures or other openings along at least a portion of a length of the annular chamber 110. Generally, the firearm suppressor 100 can include a gas entry region 111 where gases can pass from a bore within the central chamber 108 into the annular chamber 110. Apertures 109 or other openings in the inner wall 106 can be provided to allow passage of gases away from the central chamber 108. These openings can be slits, round holes, or any variety of shapes. Alternatively, the gas entry region 111 can have an absence of the inner wall 106 entirely, e.g. the inner wall 106 may begin adjacent the interleaved helical pathway 114. As a general rule, discrete perforations or apertures can be used with shotguns since such apertures reduce chances of undesirable snagging or catching of wad material by edges of the openings. In other words, larger openings can tend to retain wad material within the central chamber rather than allowing such wad material to follow projectiles (e.g. pellets) out of the bore. In either case, gases can then be directed toward and into the interleaved helical pathway 114.

As an example, each helical partition of the at least one helical partition 112 can generally have a common width (e.g. wall thickness); however, this is not required. For example, width could vary among walls or along a length of a wall. Even with a common width across partitions, this width can be chosen at varied values during design. More specifically, generally a smaller width provides for lighter weight and potentially smaller overall size as long as the width is sufficient to maintain structural integrity. For example, the width of the partitions can be from about 0.5 mm to about 5 mm depending on the caliber. Similarly, the helical partition walls can be distanced from adjacent partitions or overlapping portions of the same partition by a flow gap distance. As an example, each helical partition of the at least one helical partition 112 can have a gap distance from 2 millimeters to 12 millimeters. Most often, the gap distance can be maintained uniform along an entire length of the helical pathways. Although not required, in one example, each helical partition of the at least one helical partition 112 can also have a common helical angle. For example, each helical partition of the at least one helical partition 112 can have a helical angle from about 15 degrees to about 50 degrees from the bore axis, and in some cases about 25 degrees to about 45 degrees. Alternatively, the helical angle can be varied along a length of the partitions. In one such example, this approach can result in a corrugated helical pattern.

In some implementations, the example firearm suppressor 100 can include multiple helical partitions 112 (i.e. walls) that define multiple interleaved helical pathways 114 through the annular chamber 110. For example, the interleaved helical pathways can include multiple adjacent interleaved pathways. For example, the suppressor 100 can include two adjacent interleaved helical pathways 114, and in some cases from three to eight adjacent interleaved helical pathways 114. In some implementations, the interleaved helical pathways 114 can extend along more than half of a length of the outer housing 102. In some cases, the interleaved pathways 114 can extend from 80% to 98% of the length of the outer housing 102.

Figure 2A:
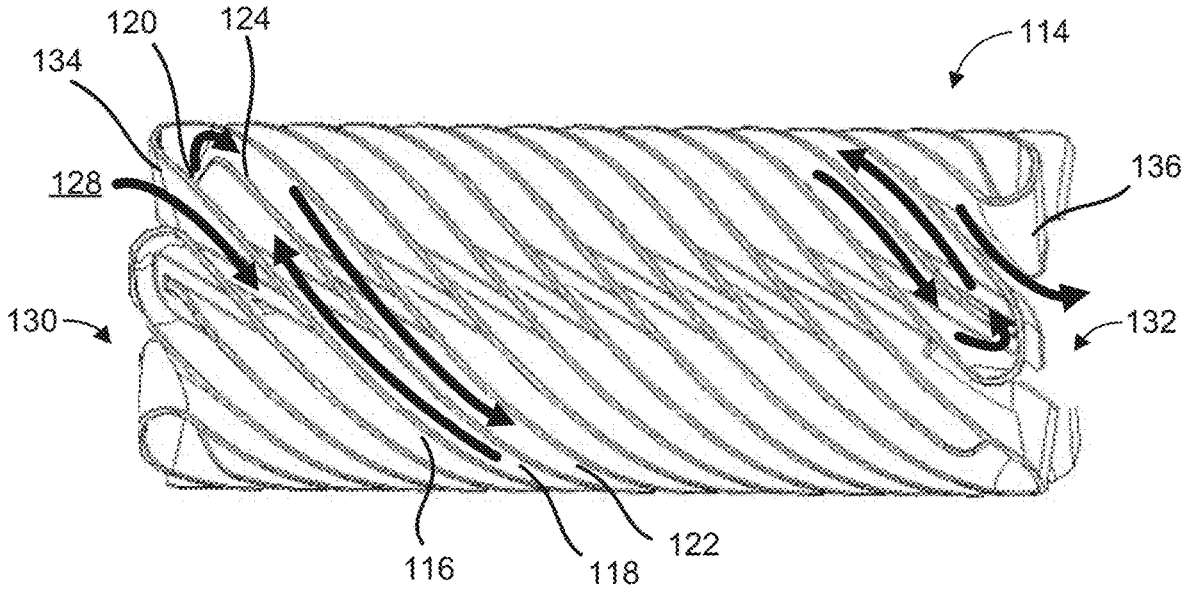
FIG. 2A is a side view of an interleaved helical pathway in accordance with one example.

Referring to FIG. 2A, additional details of an example interleaved helical pathway 114 are illustrated including flow paths. The interleaved helical pathway 114 can have a first forward helical segment 116, a reverse helical segment 118, which shares a first common wall 120 with the first forward helical segment 116. Gases can generally enter at an intake port of the first forward helical segment 116. The interleaved helical pathway 114 also includes a second forward helical segment 122, which shares a second common wall 124 with the reverse helical segment 118. As shown, the first common wall 120 and the second common wall 124 are distinct from one another. In some implementations, each of the first forward helical segment 116, the reverse helical segment 118, and the second forward helical segment 122 can comprise segments that are adjacently aligned with one another, are parallel to one another, are parallel curves, or are a combination of one or more of adjacently aligned with one another, parallel to one another, or parallel curves. In some cases, the interleaved helical pathway 114 can comprise a suppressor core which is removable from the housing. This can facilitate cleaning of the suppressor. Alternatively, the interleaved helical pathway can be integrally formed with the housing, e.g. via additive printing.

A section view A-A of FIG. 1A shown in FIG. 1B shows an end view of the example firearm suppressor 100. In some implementations, as shown in the section view A-A, the first forward helical segment 116, the reverse helical segment 118, and the second forward helical segment 122 are disposed in a common layer 126 that is concentric about the bore axis 104.

Figure 2B:
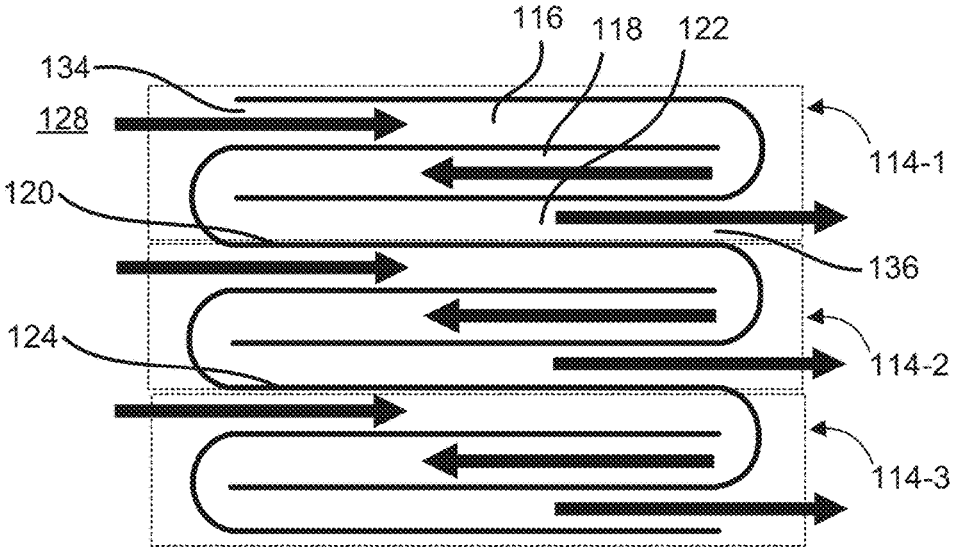
FIG. 2B is a flow path diagram illustrating flow through the interleaved helical pathway of FIG. 2A. Note that this view is a flatted, unfurled, and simplified view which also removes the helical rotation in order to more clearly show relative flow pathways.

Additionally, in some implementations, as shown in FIG. 2B, the first forward helical segment 116 extends at least partway along the length of the annular chamber 110 to define a continuous passage 128 (shown as thick arrows) beginning proximate to a rearward end 130 of the annular chamber 110 and ending proximate to a forward end 132 of the annular chamber 110. Similarly, the reverse helical segment 118 extends at least partway back along the length of the annular chamber 110 toward the rearward end 130 of the annular chamber 110 and the second forward helical segment 122 extends at least partway forward along the length of annular chamber 110 toward the forward end 132 of the annular chamber 110. Further, as shown in FIG. 2A, each of the at least one interleaved helical pathways 114 through the annular chamber 110 can also include at least one intake port 134 proximate to the rearward end 130 of the annular chamber 110 and at least one exit port 136 proximate to the forward end 132 of the annular chamber 110. Note that FIG. 2B is not illustrated to scale and would typically be extended considerably in length left to right.

The at least one intake ports 134 can be proximate to the rearward end 130 of the annular chamber 110 at various distances. For example, within five, two, or one percent of a length of the outer housing 102 of the firearm sound suppressor 100 from the rearward end 130 of the annular chamber 110. Similarly, in this example, each of the at least one exit ports 136 can be proximate to the forward end 132 of the annular chamber 110 at various distances. For example, within five, two, or one percent of the length of the outer housing 102 of the firearm sound suppressor 100 from the forward end 132 of the annular chamber 110.

FIG. 2B shows a simplified view of three interleaved helical pathways 114-1, 114-2, and 114-3. The interleaved helical pathways 114-1, 114-2, and 114-3 are shown unrolled (e.g., shown flat rather than in the common layer 126 concentric about the bore axis 104) and untwisted (e.g., shown linearly rather than helically twisted), to provide clarity and show the entire interleaved helical pathway 114 through the annular chamber 110. FIG. 2B shows the continuous passage 128 for each helical pathway 114, which for clarity is not labeled on 114-2 and 114-3. The detail view also shows the first common wall 120 and the second common wall 124, along with an example intake port 134 and an example exit port 136 (again, shown only on 114-1, for clarity).

Figure 3:
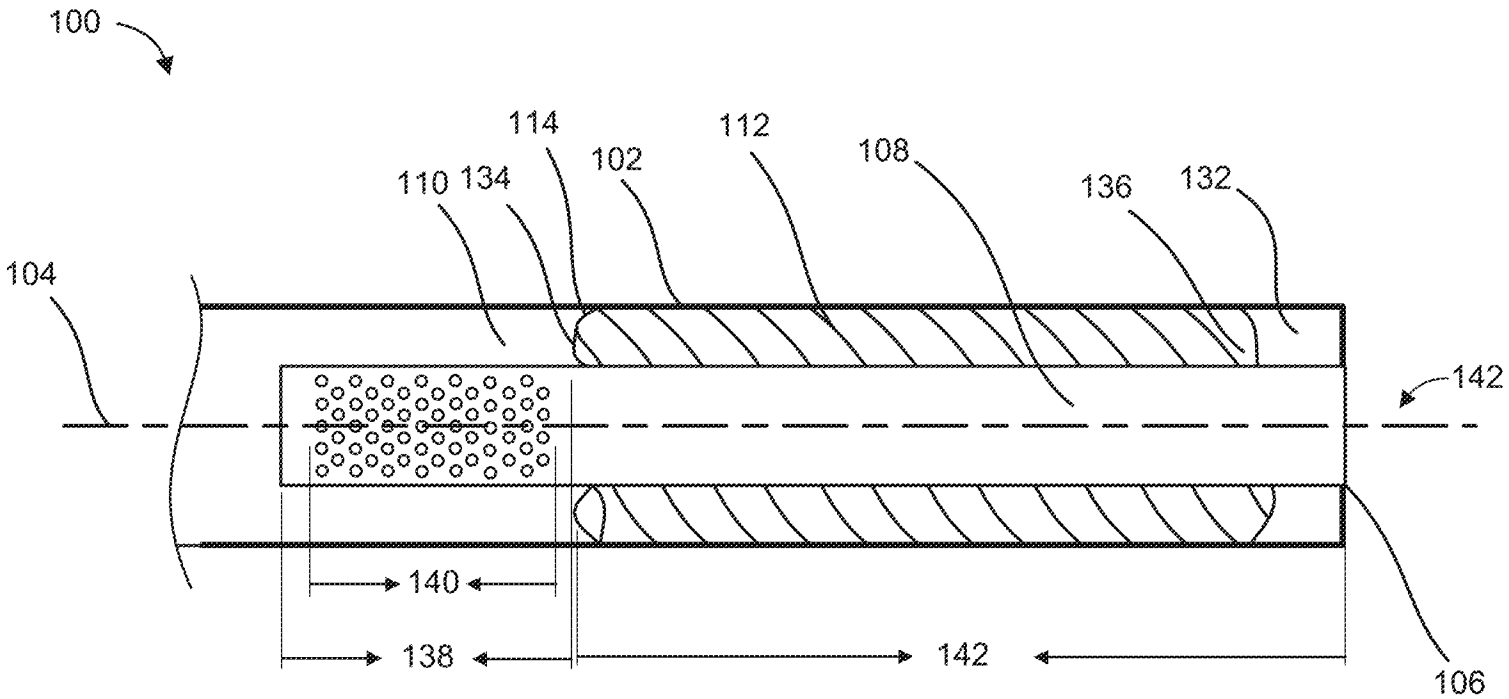
FIG. 3 is a side cross-section view of the interleaved helical pathway of FIG. 1A including a perforated section in accordance with another example.

In another example shown in FIG. 3, the cylindrical central chamber 108, including the inner wall 106, can include a segment 138 that extends away from a rearward end 130 of the annular chamber 110. The segment 138 can include a perforated portion 140. The perforated portion 140 can be designed to allow gases to be redirected away from the central chamber 108 and into the annular chamber 110. Once in the annular chamber 110, gases can enter the interleaved helical pathway 114.

In some implementations, the perforated portion 140 extends no more than about fifty percent of a distance from a rearward end of the central chamber 108 (corresponding to the rearward end 130 of the annular chamber 110) toward a forward end of the central chamber 108 (corresponding to the forward end 132 of the annular chamber 110). In some implementations, the perforated portion 140 extends no more than about forty percent of the distance from the rearward end of the central chamber 108 toward the forward end of the central chamber 108 or no more than about thirty percent of the distance from the rearward end of the central chamber 108 toward the forward end of the central chamber 108. Thus, the perforated portion 140 can extend, for example, twenty percent, thirty percent, forty percent, or about fifty percent of the distance from the rearward end of the central chamber 108 toward the forward end of the central chamber 108. In one example, forward portions 142 can be free of any openings, apertures, perforations or other fluid communication ports. In another example, the forward portions 142 can be generally aligned with the helical pathways 114.

In some implementations, the segment 138 and/or housing 102 can be configured to connect to a coupling mechanism that couples to a muzzle of a projectile weapon. For example, the coupling mechanism can include threads that couple with threads internal to the muzzle of the projectile weapon (e.g., internal threads for receiving a choke tube). The coupling mechanism can connect to the segment 138 using any suitable techniques (e.g., a press fit, threads, welds, quick connects, and so forth). Of course, the coupling mechanism can also include an intermediate adapter which couples directly with the muzzle and provides a corresponding coupling end to connect with the suppressor 100.

Similarly, a forward end of the firearm sound suppressor 100, corresponding to the forward end 132 of the annular chamber 110, can be configured to couple an accessory of the projectile weapon to the forward end of the firearm sound suppressor 100. For example, the forward end of the firearm sound suppressor 100 can be threaded (e.g., internal threads at the forward end of the central chamber 108) to allow coupling with a choke tube or other accessory. In other examples, the forward end of the firearm sound suppressor 100 can be configured to connect to another coupling mechanism that couples to the accessory.

In some implementations, and referring to FIGS. 2A and 3, each intake port 134 can be configured for fluid communication with the cylindrical central chamber 108 through at least one opening in the inner wall 106 (e.g., through the perforated portion 140). In this way, each intake port 134 can direct at least a portion of a propulsion gas discharged by the projectile weapon through an associated interleaved helical pathway 114 to dissipate a portion of the energy of the gas. Such fluid communication can be provided through perforations, slits, apertures or other openings in the inner wall 106. Alternatively, a common chamber can be provided upstream of the interleaved helical pathway 114 allowing gases to freely leave the central chamber 108 and mix with an initial rearward region of the annular chamber 110.

Similarly, in these examples, each exit port 136 can direct at least a portion of the propulsion gas out of the forward end 132 of the annular chamber 110. In some implementations, each exit port 136 that exhausts the propulsion gas out of the forward end 132 of the annular chamber 110 separate from a forward opening 142 of the cylindrical central chamber 108, corresponding to the forward end 132 of the annular chamber 110. For example, in cases where the perforated portion 140 does not extend past the rearward end 130 of the annular chamber 110, the cylindrical central chamber 108 and the annular chamber 110 are in fluid communication only via the perforated portion 140 and the at least one intake port 134. In this case, the portion of the gas that is exhausted through the annular chamber 110 is separate from any gas exhausted from the forward opening 142. As noted, the interleaved helical pathway 114 (e.g., a nested serpentine flow pathway) allows discharged gases to travel helically back and forth (e.g., forward and rearward). This approach can result in substantially reduced back pressure in the firearm and substantially similar exit velocity compared to unsuppressed operation of the same firearm. The back-and-forth travel can also reduce the length of the suppressor compared to other designs with similar sound suppression performance.

Figure 4A:
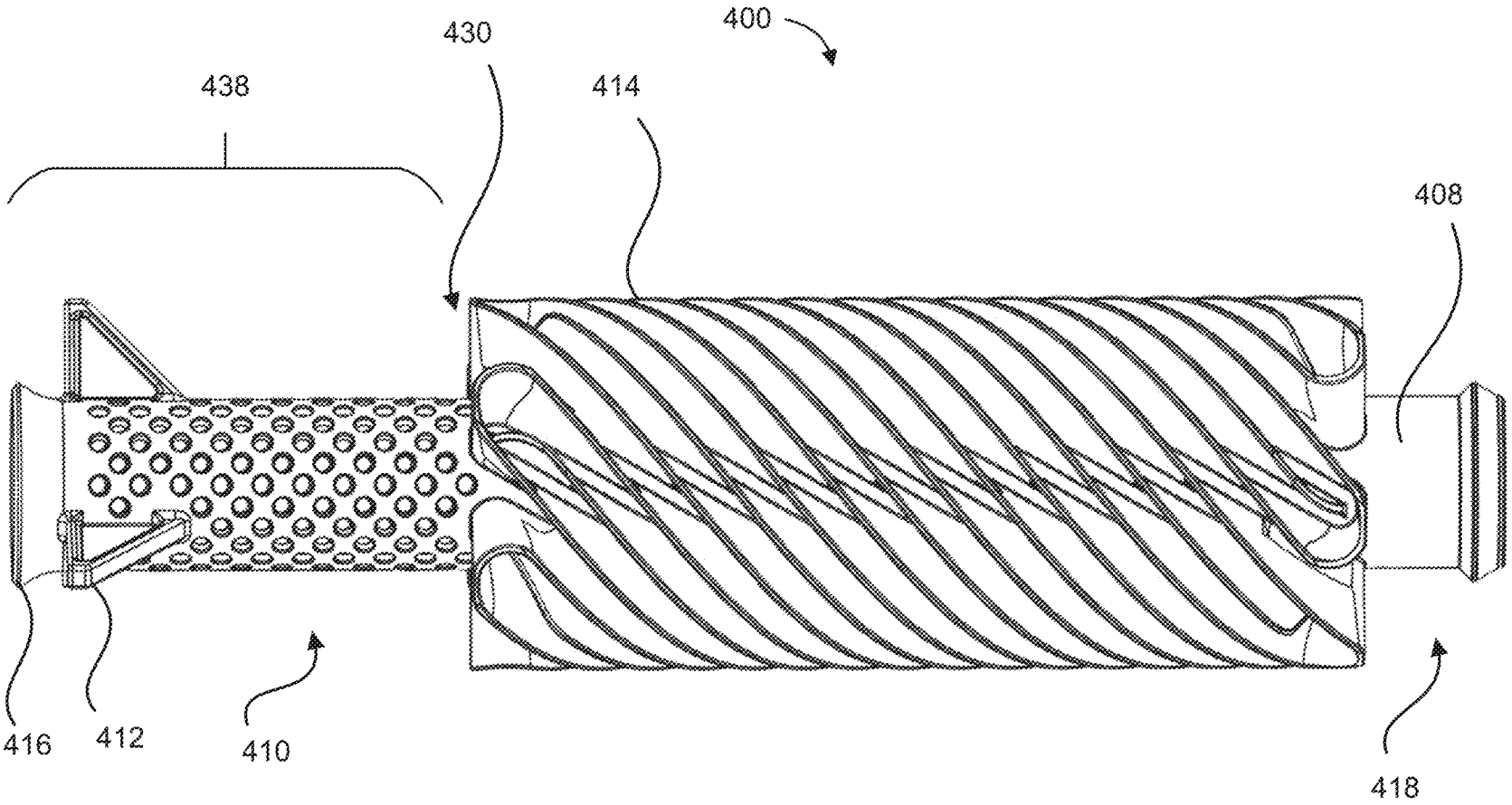
FIG. 4A is a right side view of a suppressor core with an interleaved helical pathway and a perforated segment in accordance with one example.

FIG. 4A is a right-side view of a suppressor core 400 with an interleaved helical pathway and a perforated segment similar in some respects to FIG. 3. Accordingly, similar items are numbered accordingly, e.g. 4*xx*. In this case, a gas diversion segment 438 extends away from a rearward end 430 of an interleaved helical pathway 414. The gas diversion segment 438 includes perforations which allow gases to be drawn out of the central chamber 408 and into an adjacent annular chamber 410. The gas diversion segment 438 can also include stabilization struts 412 which extend away from an outer surface of the segment. These stabilization struts 412 can have a height which aligns with an inner diameter of a corresponding housing (see FIG. 5, for example) such that lateral movement of the suppressor core is minimized or eliminated during assembly and use. The gas diversion segment 438 can also include a coupling mechanism 416 which can be directly coupled with a muzzle end of a firearm, or to an intermediate coupling adapter which is connectable to the muzzle end. As described previously, the interleaved helical pathway 414 can extend a substantial portion of the suppressor and most often to within about 10% of a length of the suppressor. In the illustrated suppressor core 400, the interleaved helical pathway 414 terminates at a location prior to an end of the central chamber 408 to form an exit chamber 418.

Figure 4B:
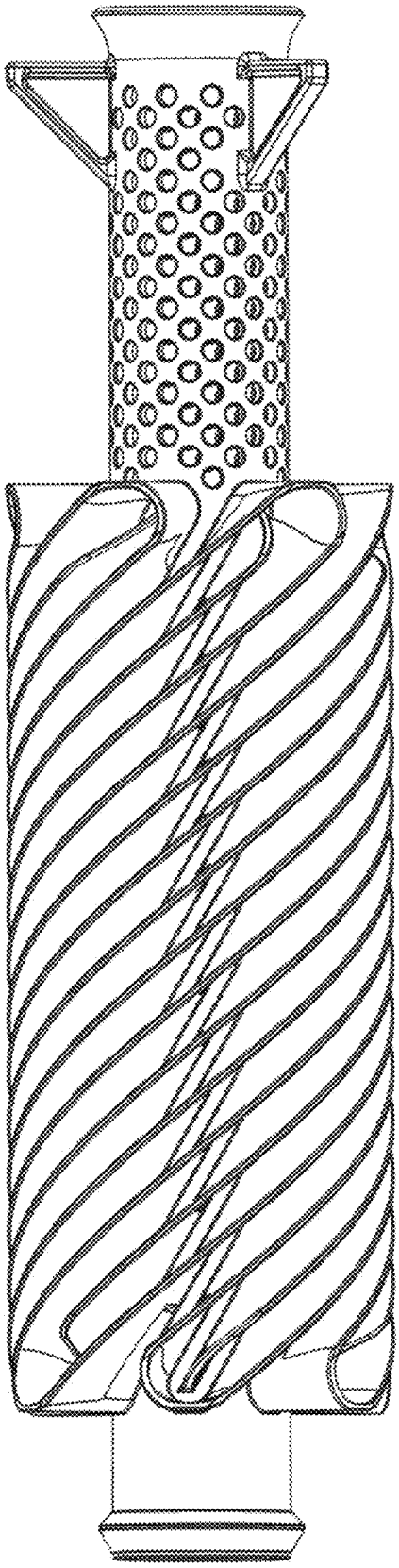
FIG. 4B is a left side view of a suppressor core with an interleaved helical pathway and a perforated segment in accordance with the example of FIG. 4A.
Figure 4C:
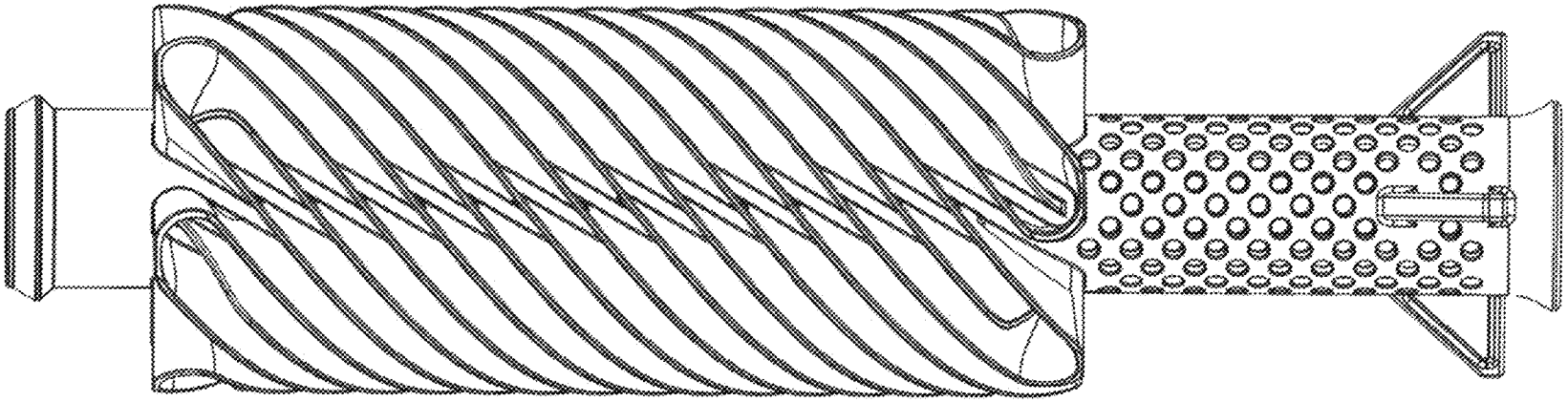
FIG. 4C is a top view of a suppressor core with an interleaved helical pathway and a perforated segment in accordance with the example of FIG. 4A.
Figure 4D:
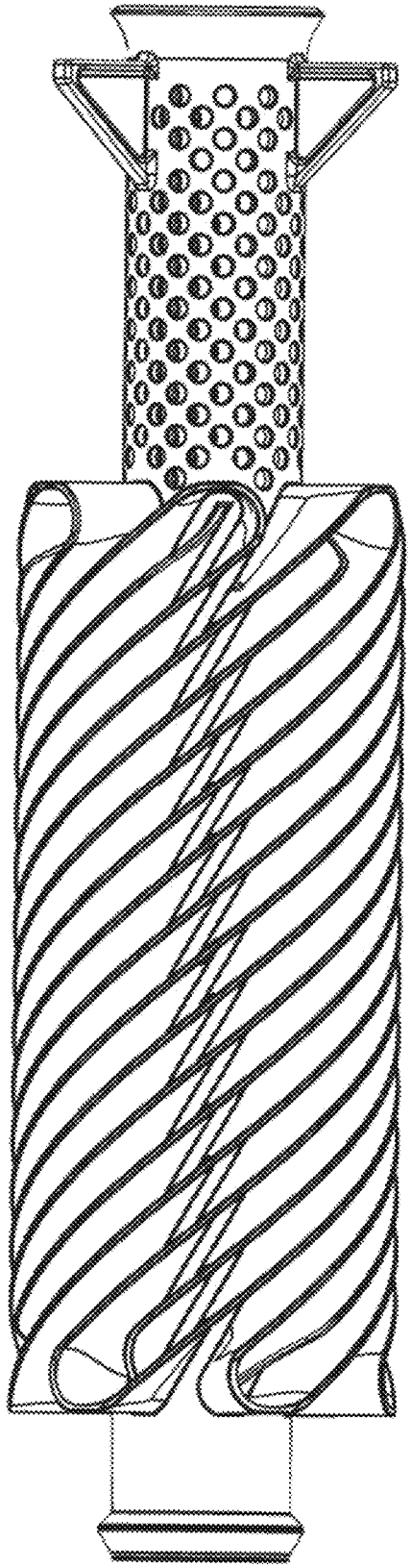
FIG. 4D is a top view of a suppressor core with an interleaved helical pathway and a perforated segment in accordance with the example of FIG. 4A.
Figure 4E:
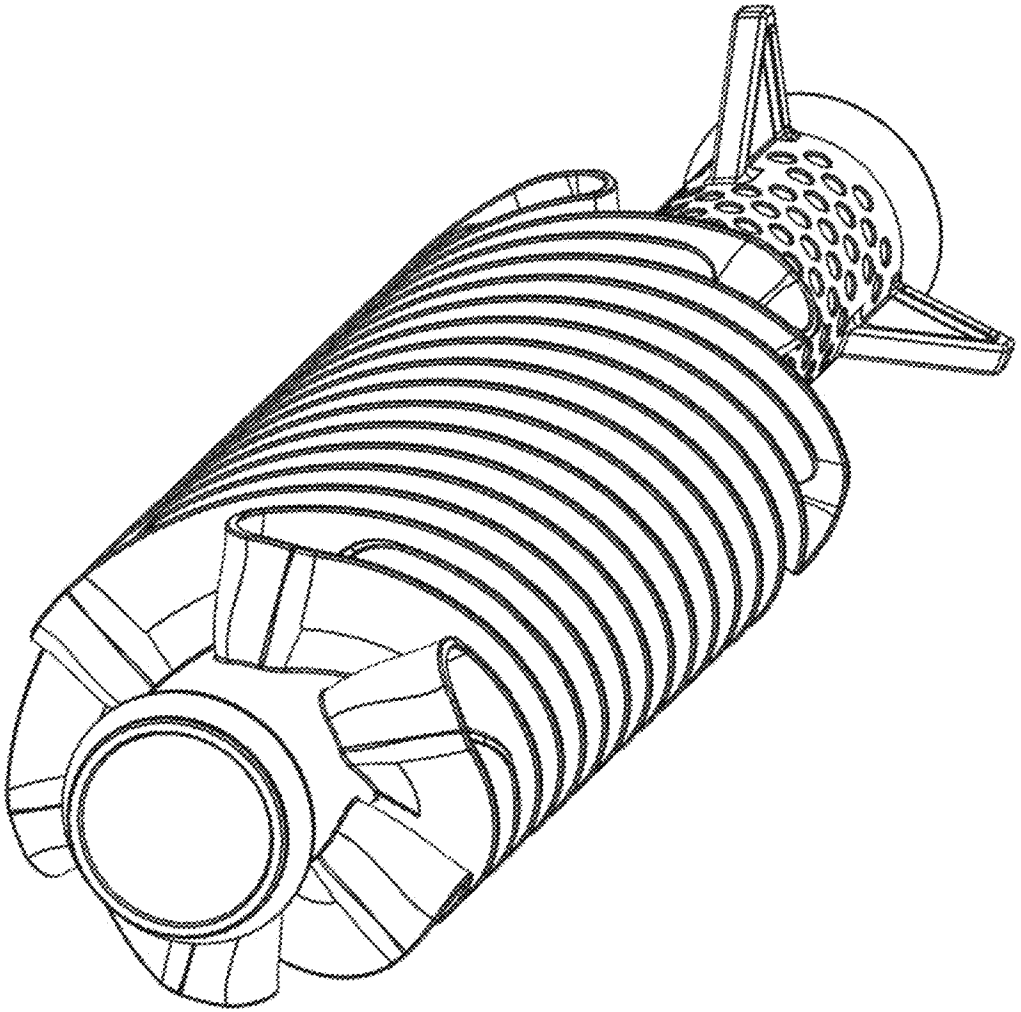
FIG. 4E is a front right perspective view of a suppressor core with an interleaved helical pathway and a perforated segment in accordance with the example of FIG. 4A.
Figure 4F:
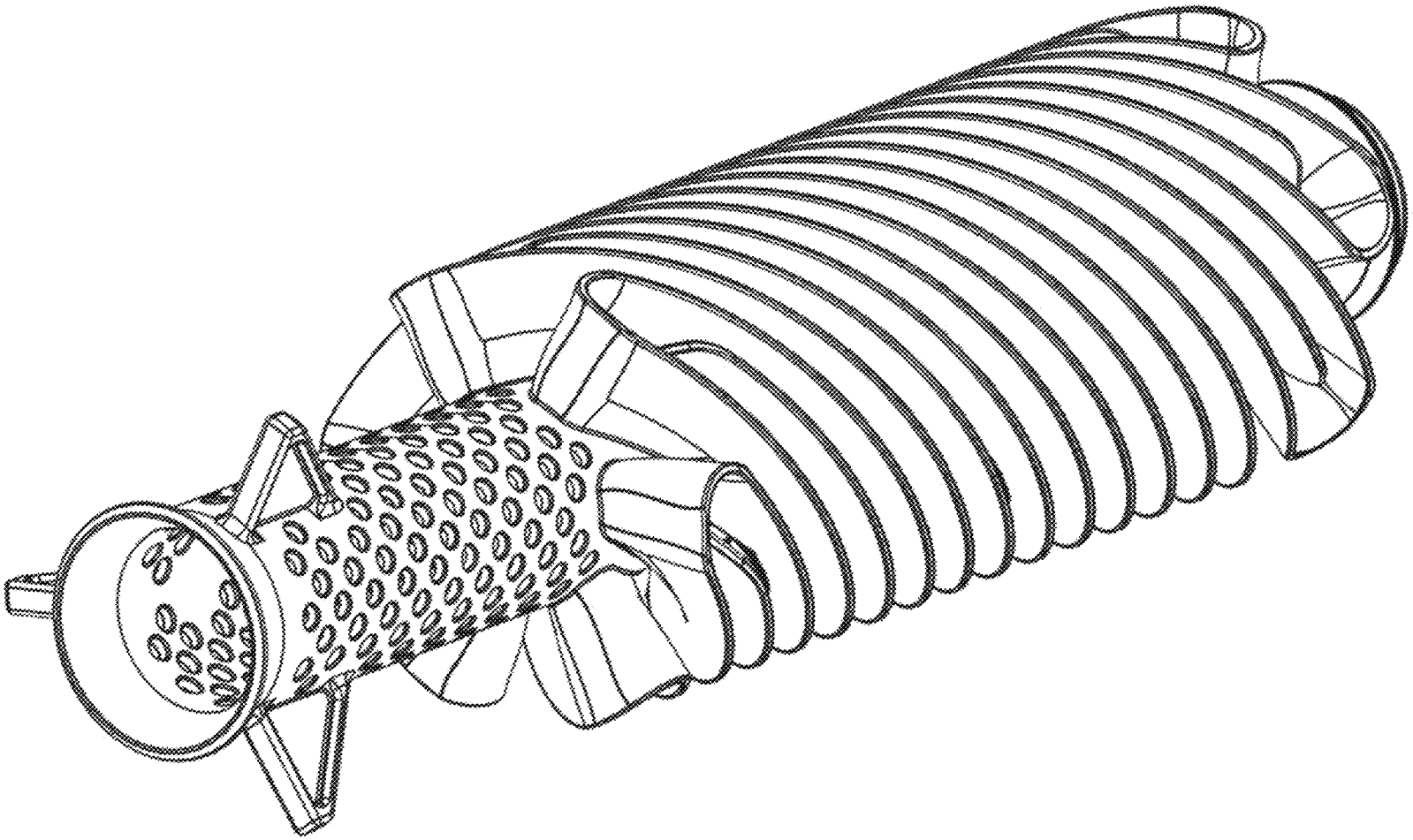
FIG. 4F is a back left perspective view of a suppressor core with an interleaved helical pathway and a perforated segment in accordance with the example of FIG. 4A.
Figure 4H:
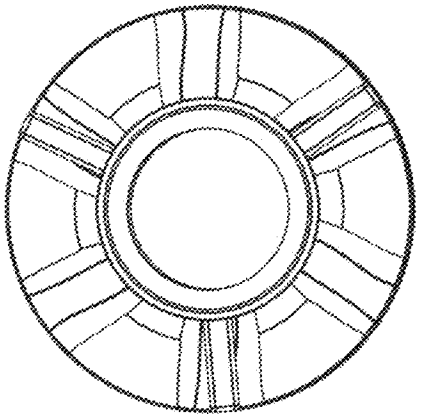
FIG. 4H is a back (inlet) plan view of a suppressor core with an interleaved helical pathway and a perforated segment in accordance with the example of FIG. 4A.
Figure 4G:
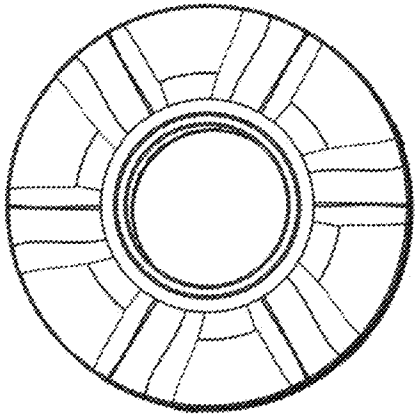
FIG. 4G is a front (exit) plan view of a suppressor core with an interleaved helical pathway and a perforated segment in accordance with the example of FIG. 4A.

FIG. 4B is a left-side view of a suppressor core with an interleaved helical pathway and a perforated segment. FIG. 4C is a top view of a suppressor core with an interleaved helical pathway and a perforated segment. FIG. 4D is a top view of a suppressor core with an interleaved helical pathway and a perforated segment. FIG. 4E is a front right perspective view of a suppressor core with an interleaved helical pathway and a perforated segment. FIG. 4F is a back left perspective view of a suppressor core with an interleaved helical pathway and a perforated segment. FIG. 4G is a front (exit) plan view of a suppressor core with an interleaved helical pathway and a perforated segment. FIG.

4H is a back (inlet) plan view of a suppressor core with an interleaved helical pathway and a perforated segment.

Figure 5:
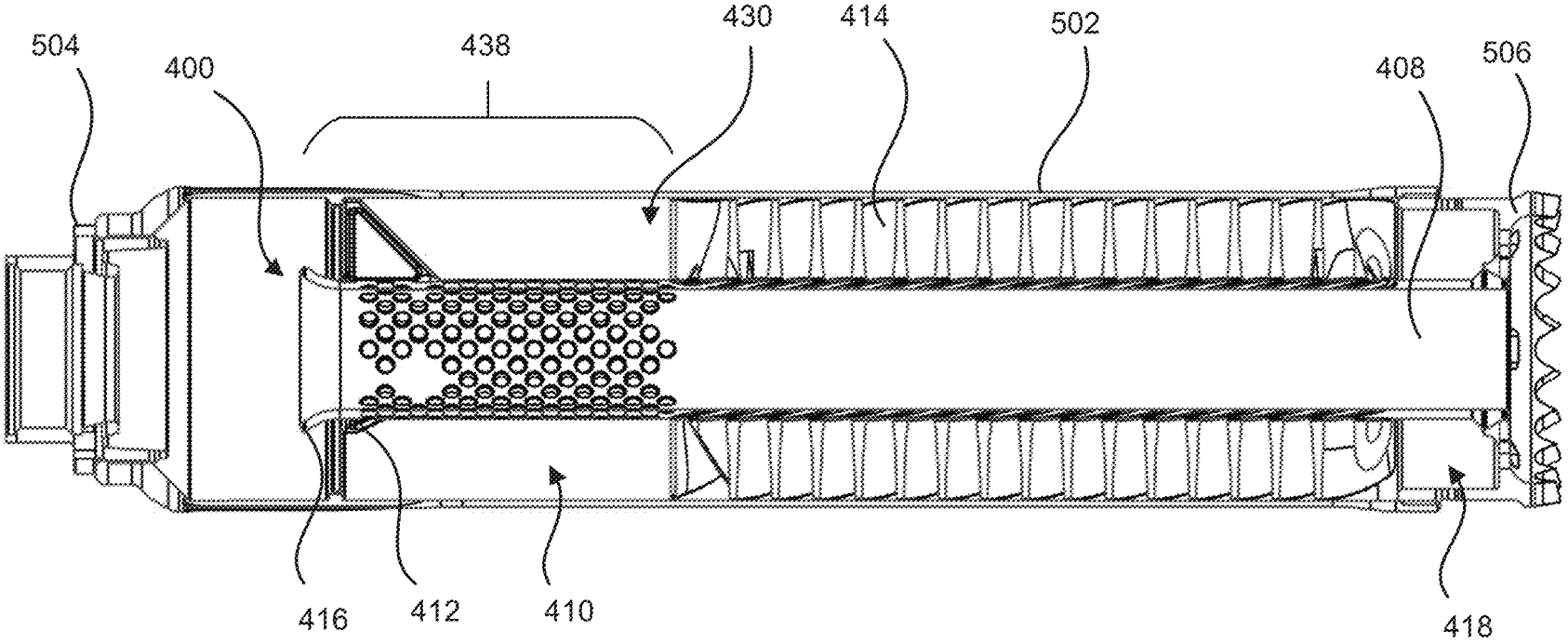
FIG. 5 is a side cross-sectional view of the suppressor core of FIG. 4A-4H oriented within a suppressor housing including an adapter mounting cap and a standoff end cap in accordance with another example.

FIG. 5 is a side cross-sectional view of a suppressor 500 including the suppressor core 400 of FIG. 4A-4H oriented within a suppressor housing 502 including an adapter mounting cap 504 and a standoff end cap 506 in accordance with another example. The adapter mounting cap 504 can include a coupling mechanism to couple with a muzzle end of a firearm (e.g. via either internal or external threads) at an inlet end of the adapter mounting cap 504. At an outlet end of the adapter mounting cap 504 a corresponding coupling mechanism can be used to allow connection with the suppressor housing 502 and/or suppressor core 400. The standoff end cap 506 can similarly include a suitable coupling mechanism to allow removable coupling with the suppressor housing 502. Of course, in some cases, the end cap can be formed integrally with the suppressor housing and/or suppressor core. As illustrated, some examples of the standoff end cap 506 can include standoff protrusions. Such standoff protrusions can provide protection of an outlet end of the chamber, allow for breaking of glass or other obstructions, and provide gas exits during discharge at a moment the standoff protrusions are engaged against a surface.

These firearm suppressors can be formed via any suitable technique including, but not limited to, additive manufacturing, CNC machining, molding, and the like. The suppressors can also be formed from suitable materials such as, but not limited to, titanium, stainless steel, INCONEL, aluminum, high impact resins, carbon composites, and the like.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A firearm sound suppressor comprising:

an outer housing defining a bore axis;

an inner wall disposed at least partially within the outer housing, the inner wall oriented about and centered along the bore axis and including a cylindrical central chamber;

an annular chamber disposed between the outer housing and the inner wall; and at least one helical partition disposed in the annular chamber to define at least one interleaved helical pathway through the annular chamber, each of the at least one interleaved helical pathway including a first forward helical segment, a reverse helical segment sharing a first common wall with the first forward helical segment, and a second forward helical segment sharing a second common wall with the reverse helical segment, wherein the first common wall and the second common wall are distinct from one another.

2. The firearm sound suppressor of claim 1, wherein the first forward helical segment, the reverse helical segment, and the second forward helical segment are disposed in a common layer that is concentric about the bore axis.

3. The firearm sound suppressor of claim 1, wherein the first forward helical segment extends at least partway along a length of the annular chamber to define a continuous passage beginning proximate to a rearward end of the annular chamber and ending proximate to a forward end of the annular chamber.

4. The firearm sound suppressor of claim 3, wherein the reverse helical segment extends at least partway back along the length of the annular chamber toward the rearward end of the annular chamber.

5. The firearm sound suppressor of claim 4 wherein the second forward helical segment extends at least partway forward along the length of annular chamber toward the forward end of the annular chamber.

6. The firearm sound suppressor of claim 1, wherein the cylindrical central chamber, including the inner wall, includes a segment that extends away from a rearward end and toward a forward end of the annular chamber.

7. The firearm sound suppressor of claim 6, wherein the segment that extends away from the rearward end of the annular chamber is configured to couple to a muzzle of a projectile weapon.

8. The firearm sound suppressor of claim 6, wherein the segment that extends away from the rearward end of the annular chamber includes a perforated portion.

9. The firearm sound suppressor of claim 8, wherein the perforated portion of the central chamber extends no more than fifty percent of a distance from the rearward end of the central chamber toward the forward end of the central chamber.

10. The firearm sound suppressor of claim 8, wherein the perforated portion of the central chamber extends:

no more than forty percent of a distance from the rearward end of the central chamber toward the forward end of the central chamber; or no more than thirty percent of a distance from the rearward end of the central chamber toward the forward end of the central chamber.

11. The firearm sound suppressor of claim 1, wherein each interleaved helical pathway through the annular chamber defined by each of the at least one helical partition includes:

at least one intake port proximate to a rearward end of the annular chamber; and at least one exit port proximate to a forward end of the annular chamber.

12. The firearm sound suppressor of claim 11, wherein:

each of the at least one intake ports is proximate to the rearward end of the annular chamber within:

five percent of a length of the outer housing of the firearm sound suppressor;

two percent of the length of the outer housing of the firearm sound suppressor; or one percent of the length of the outer housing of the firearm sound suppressor; and each of the at least one exit ports is proximate to the forward end of the annular chamber within:

five percent of the length of the outer housing of the firearm sound suppressor;

two percent of the length of the outer housing of the firearm sound suppressor; or one percent of the length of the outer housing of the firearm sound suppressor.

13. The firearm sound suppressor of claim 11, wherein each intake port is configured for fluid communication with the cylindrical central chamber through at least one opening in the inner wall.

14. The firearm sound suppressor of claim 11, wherein each intake port is configured to direct at least a portion of a propulsion gas generated by a projectile weapon through an associated interleaved helical pathway to dissipate a portion of energy of the gas.

15. The firearm sound suppressor of claim 14, wherein each exit port is configured to direct at least a portion of the propulsion gas out of the forward end of the annular chamber.

16. The firearm sound suppressor of claim 15, wherein each exit port configured to direct at least a portion of the propulsion gas out of the forward end of the annular chamber is separate from a forward opening of the cylindrical central chamber.

17. The firearm sound suppressor of claim 15, wherein:

the cylindrical central chamber and the annular chamber are in fluid communication only via a perforated portion of the cylindrical chamber and the at least one intake port; and the at least a portion of the propulsion gas that is exhausted out of the forward end of the annular chamber is separate from another portion of the propulsion gas exhausted out of the forward end of the cylindrical central chamber.

18. The firearm sound suppressor of claim 1, wherein the at least one helical partition disposed in the annular chamber to define the interleaved helical pathway through the annular chamber further comprises three to eight adjacent interleaved helical pathways.

19. The firearm sound suppressor of claim 1, wherein the at least one helical partition has a gap distance from 2 millimeters to 12 millimeters.

20. The firearm sound suppressor of claim 1, wherein the at least one helical partition has a helical angle from 15 degrees to 50 degrees from the bore axis.

21. The firearm sound suppressor of claim 1, wherein the interleaved helical pathway through the annular chamber defined by the at least one helical partition disposed in the annular chamber extends along more than half of a length of the outer housing.

22. The firearm sound suppressor of claim 1, wherein each of the first forward helical segment, the reverse helical segment, and the second forward helical segment comprise non-intersecting segments, each having a width that is a common width.

23. The firearm sound suppressor of claim 1, wherein each of the first forward helical segment, the reverse helical segment, and the second forward helical segment comprise segments that are at least one of:

adjacently aligned with one another;

parallel to one another; and parallel curves.

* * * * *